United States Patent [19]

Tucker et al.

[11] 3,957,323

[45] May 18, 1976

[54] STORAGE MEANS WITH SEQUENTIALLY SHIFTABLE UNITS

[75] Inventors: Frank Philip Tucker, Oceanport; Sherburn M. Becker, III, Little Silver, both of N.J.

[73] Assignee: Estey Corporation, Red Bank, N.J.

[22] Filed: Sept. 2, 1970

[21] Appl. No.: 69,012

[52] U.S. Cl. ..... 312/198; 104/148 R; 214/16 B

[51] Int. Cl.[2] ..... A47B 53/00

[58] Field of Search ..... 312/198–201; 104/148, 149, 162

[56] References Cited

UNITED STATES PATENTS

| | | | |
|---|---|---|---|
| 2,605,911 | 8/1952 | Medway | 214/16.1 CC |
| 2,617,546 | 11/1952 | Rosener | 214/44 R |
| 3,640,595 | 2/1972 | Staller et al. | 312/198 |

FOREIGN PATENTS OR APPLICATIONS

| | | | |
|---|---|---|---|
| 1,557,743 | 2/1969 | France | 104/162 |

*Primary Examiner*—George H. Libman
*Attorney, Agent, or Firm*—Anthony J. Casella

[57] ABSTRACT

A series of storage stacks, such as bookcases, are mounted on a track with controlled power means for moving them to provide a single aisle between any two stacks. The remaining stacks are in contact with each other, thereby conserving space and lighting means. The movement of the stacks, the lighting above the open aisle, and the safety features are all automatically controlled. All controls are mounted above the floor level.

10 Claims, 9 Drawing Figures

INVENTOR
FRANK PHILIP TUCKER
SHERBURN M BECKER III

By James R. Heilman
ATTORNEY

INVENTOR

FRANK PHILIP TUCKER
SHERBURN M. BECKER III

By James R. Heilman
ATTORNEY

STORAGE MEANS WITH SEQUENTIALLY SHIFTABLE UNITS

A series of storage stacks, such as bookcases, are mounted on a track with controlled power means for moving them to provide a single aisle between any two stacks. The remaining stacks are in contact with each other, thereby conserving space. The movement of the stacks, the lighting above the open aisle, and safety features are all automatically controlled. All controls are mounted above the floor level.

Movable storage stacks for books and small parts have been in use for some time to conserve space and to add security against unauthorized removal of contents. Prior stacks have, in most cases, been difficult to operate, requiring a sequence of manual operations to activate safety devices or else depend upon slip clutches or similar devices to prevent injury to personnel. Also, most of the prior stacks were moved by chains, cables, or shafts mounted under the floor.

The present invention includes a control system which is completely automatic, being operated by push buttons which any person can use. There are a number of safety means incorporated in the system which prevent motor operation once the stacks are in use. All the controls, including the motors, are mounted above the floor, the only components below the floor level are two rails which support wheels secured to the stacks. If the electrical power is cut off, the stacks can be pushed manually with little effort since the wheels are mounted on ball bearings and the stacks are not connected to any chains or operating rods which act as restraints.

One of the features of the invention is the individual operation of each range of stacks. A control means and a motor are part of each stack so that it can be moved independently of the other stacks.

Another feature of the invention is the safety means built into the control system whereby three means are provided for preventing the reduction of aisle space when a person is in the aisle.

For a better understanding of the present invention together with other details and features thereof, reference is made to the following description taken in connection with the accompanying drawings.

BRIEF DESCRIPTION OF THE FIGURES:

FIGS. 8 and 9 should be joined end-to-end for proper viewing.

DESCRIPTION OF THE PREFERRED EMBODIMENT

Figure 1:
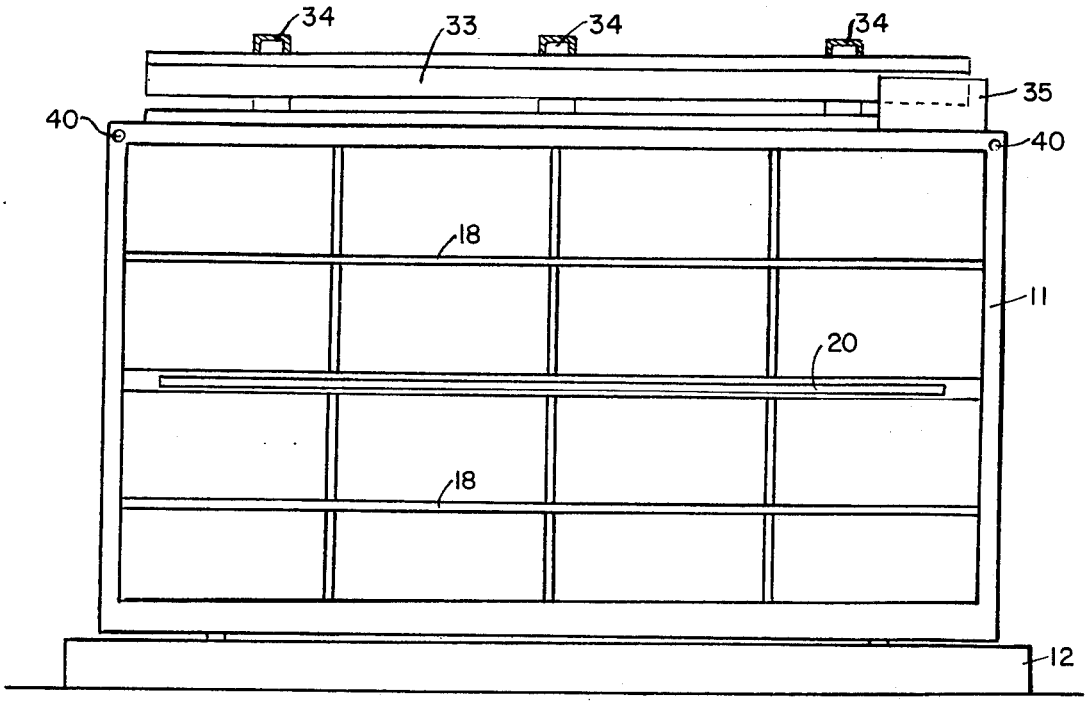
FIG. 1 is a side view of one of the storage stacks.
Figure 2:
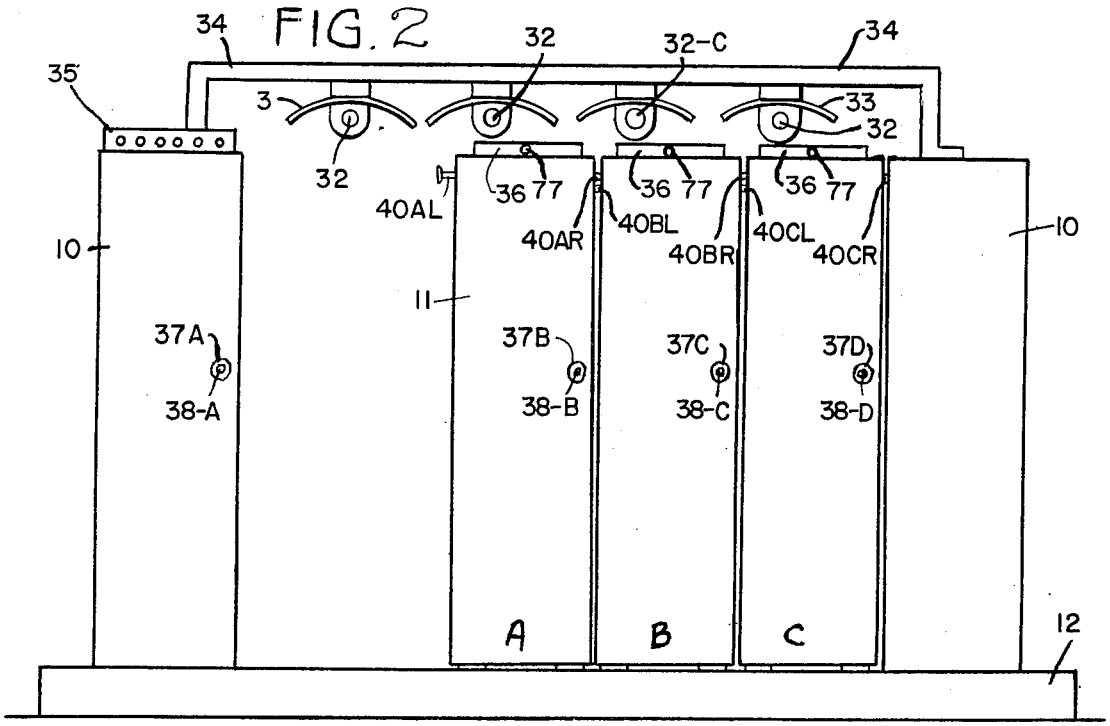
FIG. 2 is a side view of all the stacks in one group, showing the lighting fixtures.
Figure 3:
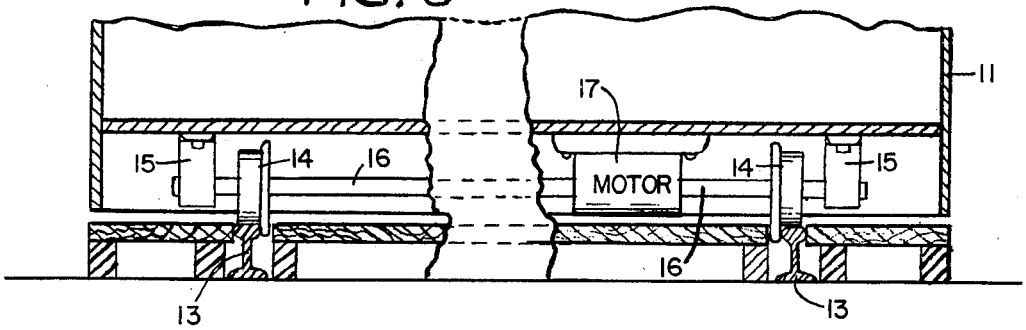
FIG. 3 is a cross sectional view of the base of one of the stacks showing the rails, the wheels, and the position of the motor.
Figure 4:
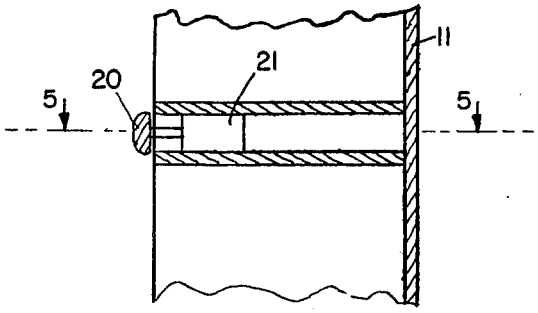
FIG. 4 is a cross sectional view of a portion of a stack showing the safety rail which cuts off power to the motor when pressed.
Figure 5:
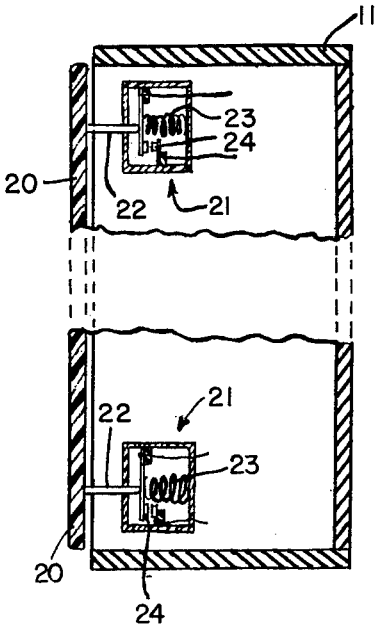
FIG. 5 is a cross sectional view of the safety rail shown in FIG. 4 and is taken along line 5—5 of that Figure.

Referring now to FIGS. 1 and 2, the assembly of storage stacks includes five stacks, two stacks numbered 10 which are stationary, and three stacks 11 which are movable. If desired, only one of the stacks can be stationary with four movable portions. In this case the lamps must be secured to the ceiling or to other means of support. A sub-floor 12 is mounted under all the stacks and contains the rails 13 (see FIG. 3) which support flanges wheels 14, rotatably secured to the underpart of the stacks by pillow blocks 15. The wheels 14 are secured to a shaft 16 driven by an electrical reversible motor 17. The stacks 10, 11 may be divided into shelves 18 or other compartments for the storage of books, magazines, or machine parts.

Figure 6:
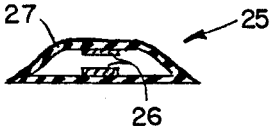
FIG. 6 is a cross sectional view of a pressure operated tape, designed to close a contact when a person or obstruction presses against it.
Figure 7:
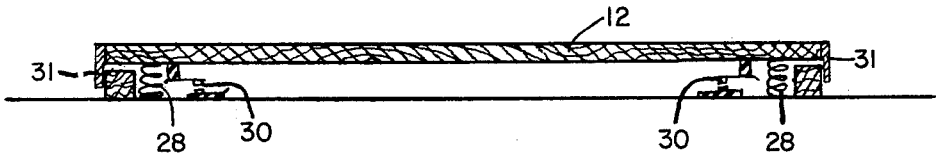
FIG. 7 is an alternate means of closing a contact when a person is in an aisle between stacks.

One of the safety means includes a waist-high pressure bar 20 extending for most of the length of the stack. At each end of the bar 20 a switch 21 is coupled to the bar by a short rod 22. The rod 22 engages a leaf spring stressed by a spring 23 which holds contacts 24 in a normally open position. If the control switches are operated to eliminate the aisle then open, the closing of any of the switches 24 short-circuits a relay winding and stops the motor. Another safety means is included in a floor level switch 25 (see FIG. 6) having upper and lower contact metal strips 26 enclosed in a rubber or plastic flat tube 27. When a person or obstruction presses against the switch, contacts 26 are closed and another relay winding is short-circuited, stopping the motor. An alternate floor switch (see FIG. 7) is mounted under the floor boards 12 which are normally kept apart by springs 28. When a person stands on this floor contacts 30 are closed and the relay winding is shorted. The floor boards are prevented from lateral movement by side strips 31 which also act to keep dust from the contact areas.

In order to conserve lighting, only one of the lamps 32 is lighted at any time. The lamps include flat reflectors 33 and are secured in place by two or three bent supporting bars 34. Most of the circuit elements for controlling the lighting and motors are enclosed in a container 35 mounted on top of one of the stationary stacks 10. Each movable stack 11 also contains a local circuit in a box 36 mounted on top of the upper stack shelf. An indicating lamp 37 shows when the adjacent aisle is being used. The stack movement is initiated by the user depressing a push button 38 adjacent to the aisle to be entered. As shown in FIG. 2, the button 38 may be part of a combination device in which the lighted area surrounds the push button. Button 38 operates a stepping switch and the first actuation opens the aisle by moving the stacks away from it. After the operator finishes his mission, he pushes the button 38 a second time, thereby normalizing part of the circuit and making the system ready for another aisle opening operation. When the motors 17 are activated, they move their associated stack to fill the open aisle. As soon as the opening is closed, the motor stops. The motor cut-off action is accomplished by a series of sensing switches 40, four for each movable stack, mounted at the upper corners of each stack.

Figure 8:
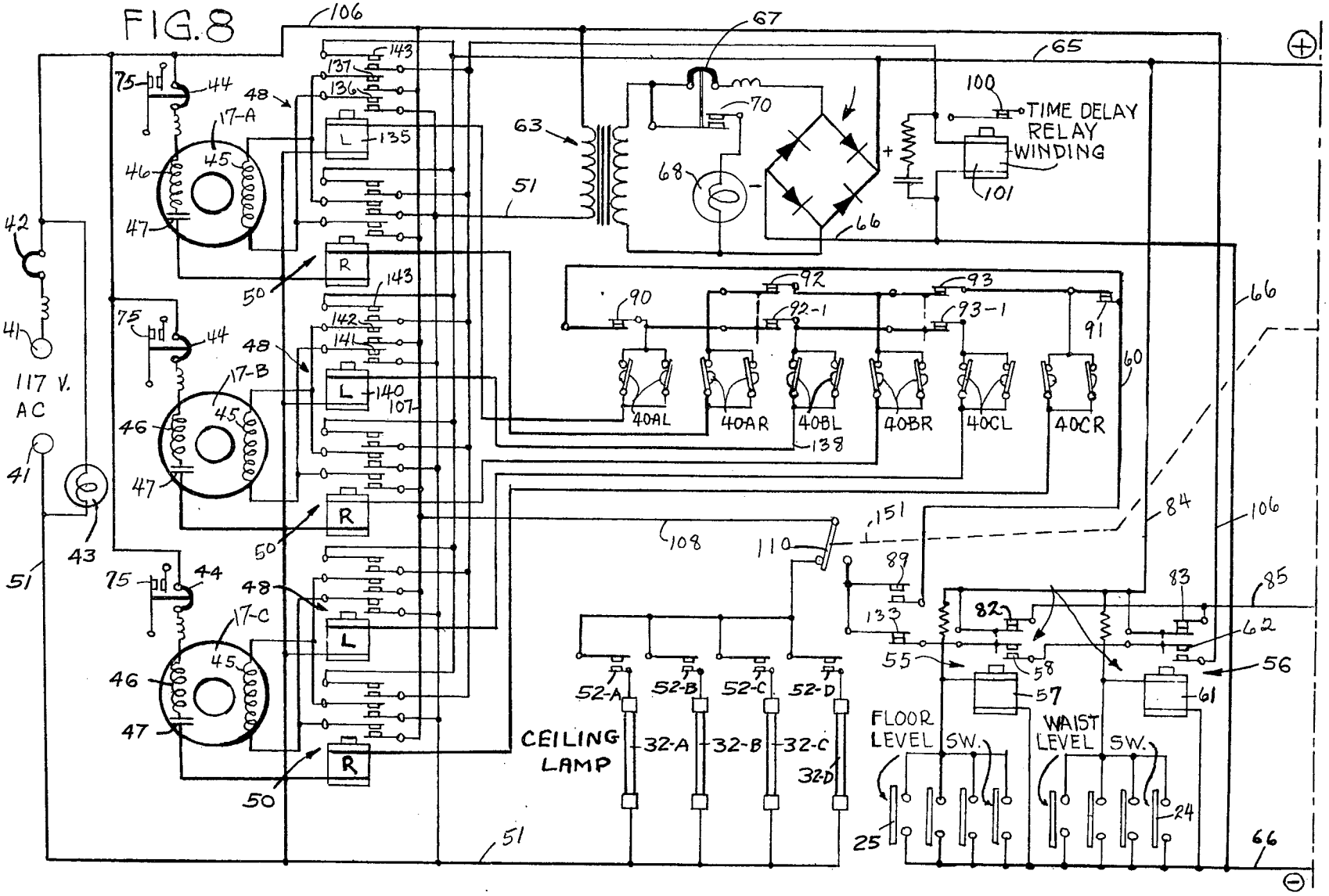
FIG. 8 is one half of a schematic diagram of connections of the stack operating system.
Figure 9:
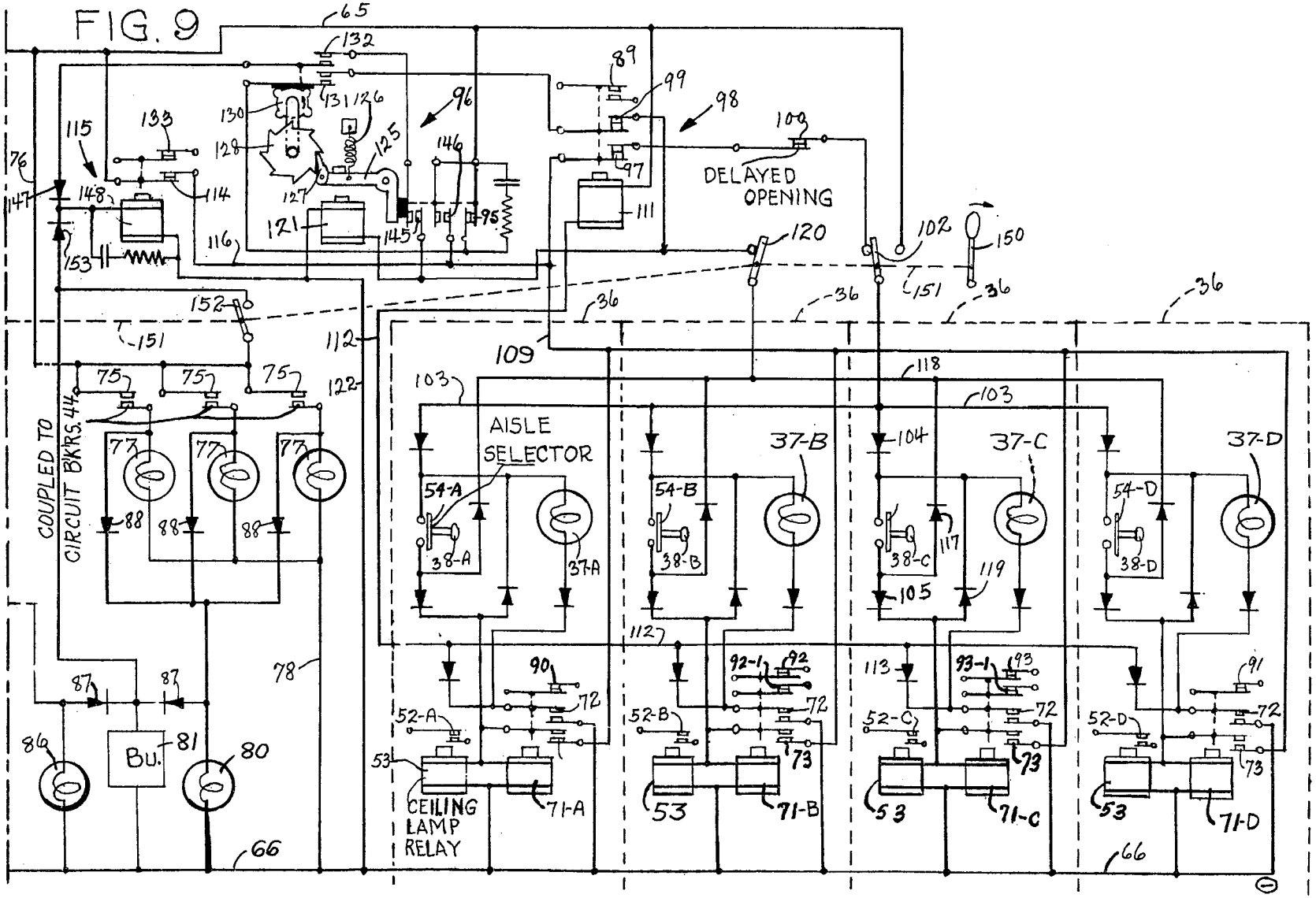
FIG. 9 is the other half of the diagram of connections of the system.

The control circuit is shown in schematic form in FIGS. 8 and 9. The circuit is powered by sixty hertz from a power line which is connected to input terminals 41. A circuit breaker 42 is in series with this line and a power line which is connected to input terminals 41. A circuit breaker 42 is in series with this line and a power indicator lamp 43 is connected to show when the power is on. Three motors 17 are connected across the power line with circuit breakers 44 in series with each. The motors 17 are reversible and for this reason have two field windings. A main winding 45 and a starter winding 46 in series with a capacitor 47 permit reversible action by reversing the current in one of the windings. A series of six relays 48 and 50 control the actuation and direction of the three motors. When none of the relays are actuated the motors do not run. Actuation of any of the three relays 48 causes the associated motor to turn in a direction to move its stack to the left. Actuation by anyone of the relays 50 moves the associated stack to the right. The three pairs of contacts on each relay are normally open and the motors do not run. One side of the relay windings 48 and 50 are connected to one of the power supply conductors 51. The other side of each winding 48, 50, is connected respectively to two of the sensing switches 40 which open the winding circuit whenever the stacks are moved close to each other.

The four ceiling lamps 32 (FIG. 8) have one side connected to conductor 51 and the other side connected respectively in series with a contact 52 which is a part of a ceiling lamp relay (FIG. 9) having a winding 53. Each time an aisle selector switch 54 is closed, a ceiling lamp relay is actuated and the lamp 32 over the selected aisle is lighted.

There are two safety relays 55 and 56 which are actuated when the power is turned on. They remain in their operated state all the time and are normalized only when one of the waist level switches 24 is operated or when one of the floor level switches 25 is closed. When the floor level switches 25 are closed, they short circuit winding 57 and contacts 58 are opened, thereby opening one of the supply lines 60 which is connected to all the sensing switches 40. This action cuts off the power supply to the motors. A similar action occurs when a waist level switch 24 is closed. Relay winding 61 is short circuited, contacts 62 are opened and again current is cut off from all the motors 17.

The motors 17, relays 48, relays 50 and lamps 32 are powered by alternating current direct from the supply mains. The remainder of the circuit, including the safety relays 55 and 56, require direct current which is furnished by a stepdown transformer 63 and a rectifier bridge 64. A positive conductor 65 and a negative conductor 66 power all the control elements shown in FIG. 9. The bridge 64 is protected by a circuit breaker 67. When the power is on and the circuit breaker in the OFF position, an indicator lamp 68 is lighted by means of contacts 70.

FIG. 9 shows the four local control units 36, one being carried by each movable stack. The four circuits are identical, each including an aisle selector switch 54, available for manual operation by persons wishing to move into closed aisle. Each circuit also has an indicating lamp 37 which is lighted when the circuit is in operation. A ceiling lamp relay is in each circuit, each relay operating a single normally open pair of contacts 52 shown in FIG. 8. A second relay winding 71 operates two normally open contacts 72 and 73. Contacts 73 are in series with the indicator lamp 37 and keep it lighted as long as the circuit is activated, and also act as holding contacts for windings 71 and 53. A number of diodes in each circuit are employed to isolate parts of the circuit and prevent current from one circuit from activating another circuit.

The three motor circuit breakers 44 (FIG. 8) each have an auxilliary pair of normally open contacts 75 coupled to the breaker arm. When the circuit breaker opens due to any overload, contacts 75 are closed and sound an alarm. The three contacts 75 are shown in the alarm circuit in FIG. 9 where a conductor 76 connects one side of all the contacts 75 to the positive supply line 65. A signal lamp 77 has one terminal connected respectively to the other side of contacts 75 and a second terminal connected to conductor 78 and the negative supply line 66. Actuation of any of the motor circuit breakers 44 closes contacts 75 and lights a signal lamp 77. Also, the other side of contacts 75 are each connected to another signal lamp 80 and a buzzer 81.

The safety relays 55 and 56, described above, are actuated when the circuit is connected to the power lines. Under these conditions, contacts 82 and 83 are open and no current flows from the positive supply line 65, over conductor 84, through contacts 82 or 83, to conductor 85. Whenever a floor level switch 25, or a waist level switch 24 is operated, one of the relays 55 or 56 is normalized, one of the contacts 82 or 83 is closed and current is sent to the buzzer 81 and signal lamp 86. Diodes 87 prevent double lighting of lamps 80 and 86 while diodes 88 prevent cross currents from lighting all of the lamps 77 when only one contact 75 is closed.

Relay windings 71 have additional normally closed contacts connected to their armatures. Contacts 90, 92—1 and 93—1 are each a part of the left selector circuit. The right selector circuit includes contacts 92, 93, and 91. These contacts are shown in their control circuits in FIG. 8.

Operation of the Aisle Selector Circuit

With the three movable stacks in the position shown in FIG. 2, an operator depresses push button 38-C in the third movable stack. Current then flows from conductor 65 (FIG. 9) through closed contacts 114 of the relay 115, then through contacts 97 of the aisle lock out relay 98, contacts 100 of the time delay relay whose winding 101 is shown in FIG. 8. Current then moves through safety switch 102 to a common conductor 103, diode 104, closed switch 54—C under button 38—C, diode 105, and both windings 53 and 71—C to the other supply conductor 66. When winding 53 receives current, lamp contacts 52—C (also shown in FIG. 8) are closed and lamp 32—C is lighted above the third aisle. Current for the lamps 32 comes from the AC supply conductor 106, then over conductor 108, through safety switch 110, to contacts 52—C, lamp 32—C and the other AC supply conductor 51.

The current through relay winding 71 closes two contacts 72 and 73 and opens two contacts 93 and 93—1. As mentioned above, contacts 73 are holding contacts and retain current in both windings 53 and 71 after the operator releases button 38—C. The holding circuit can be traced over conductors 109 and 116, through contacts 114 to supply conductor 65. When contacts 72 are closed current flows from the DC supply line 65 through winding 111 of relay 98, then over conductor 112, diode 113, through closed contacts 72 to the other DC supply line 66. This current activates relay 98 and opens contacts 97, 99 and closing contacts 89 (see FIG. 8). However, current still flows through windings 53 and 71 because of the holding circuit through contacts 73, conductor 109, and contacts 114 of relay 115.

When contacts 54—C are closed, another circuit is completed which may be traced from the positive DC supply line 65, through contacts 114, over conductors 116 and 109, through contacts 73 of relay 71—C, through diode 119 and closed switch 54—C, then through diode 117, conductor 118, safety switch 120, and winding 121 of the stepping relay 96 to the negative supply conductor 66. This current operates the stepping relay 96, first closing two contacts 145, 146 and opening one 95. When the operator releases button 38—C, switch 54—C is opened and the circuit through winding 121 of the stepping relay is broken. The stepping armature 125 snaps back into its normal position under the force of spring 126 and pawl 127 turns tooth wheel 128 one-eight of a revolution, turning cam wheel 130 and closing contacts 131 and 132.

When contacts 89 are closed, current flows over the AC supply conductor 106, through closed contacts 62, 58, 133 (on relay 115, FIG. 9), closed contacts 89 (on relay 98), over conductor 60 to contacts 90 and 109, also, contacts 92—1, 93—1, 92 and 93 if not interrupted by open contacts. With the stacks in the position shown in FIG. 2, all the sensing contacts 40 are open except those on the left of stack A. As long as relay winding 71—C receives current, contacts 93 and 93—1 remain open and current is supplied only to the relay winding 135, thereby closing contacts 136 and 137 and causing motor 17—A to turn in a direction which will close the open aisle. The stack motion continues until the sensing switches 40—AL are opened, then the relay 48A is normalized and the motor stops. A few seconds after the first stack starts to move, the sensing switches 40—BL are closed and current is supplied from conductor 60, through contacts 90 and 92—1, through sensing switches 40—BL, to conductor 138 and winding 140, thereby closing contacts 141 and 142 to activate motor 17—B and move the second stack to the left, advancing a short distance behind the first stack. When the second stack moves its desired distance, its sensing switches 40—BL are again opened by contact with the first stack and the motor stops. No additional motion is possible even though sensing switches 40—BR and 40—CL are closed. The opening of contacts 93 and 93—1 by winding 71—C prevents current from flowing through these switches.

When any of the motor relays are actuated, a third set of contacts 143 is closed. These contacts are in parallel and send current to relay winding 101, thereby opening contacts 100 (FIG. 9) and cutting off current to the aisle control circuits. While the motors are running, the control switches 54 are made inactive. However, relay winding 17—C still receives current through its locking circuit by way of contacts 114 on relay 115.

With the third aisle open, the operator makes use of the two stacks and the available sections exposed to the open aisle. When finished, the operator again depresses button 38—C to normalize the entire circuit and make it available to the next person. The second closing of switch 54—C sends current to the winding 121 of the stepping relay 96. Armature 125 is again pulled down and, on returning, again moves ratchet wheel 128 and cam wheel 130 to open contacts 131 and 132.

When the stepping relay 96 is operated the first time, contacts 145 and 146 are closed as long as the operator keeps button 38—C depressed. However, no current flows through contacts 145 because they are in series with contacts 132 which are open at this time. Also, contacts 146 cause no action because they are in parallel with closed contacts 114 on relay 115. As described above, the removal of pressure from button 38—C opens switch 54—C, cutting off current from the winding 121 and permitting armature 125 to return to its original position. This action turns cam wheel 130 and closes contacts 131 and 132. During the time interval between the first and second actuation of switch 54—C, when the operator is in the open aisle, relay 115 is in its normal unoperated condition with contacts 133 and 114 closed.

When the stepping switch 96 is operated the second time, contacts 145 and 146 are again closed. This time current is sent through winding 148 of relay 115 to actuate the relay and open contacts 114 and 133. The operating circuit which actuates relay 115 can be traced as follows: From the positive conductor 65, through contacts 146, over conductor 91, through closed contacts 73 in the third section, through diode 119, switch 54—C, diode 117, over conductor 118, switch 120, contacts 145, contacts 132, diode 147, winding 148 of relay 115, and conductor 122 to the negative conductor 66.

The opening of contacts 114, opens the locking circuit which includes contacts 114, conductors 116 and 91, contacts 73 in the third section, and windings 71—C and 53. When this locking circuit is broken, contacts 52—C are opened, putting out indicator lamp 37—C, and removing current from coil 111 of relay 98. Contacts 133 (FIG. 8) are also opened and current is cut off from the motor relays 48 and 50.

When an obstruction such as a dropped book operates any of the floor safety switches, or if any other obstruction produces an unsafe condition, the operator can actuate a "safety override" lever 150 (FIG. 9). This lever is connected to switches 102, 120, 152 and 110 (FIG. 8) by a mechanical coupling illustrated in the drawings by dotted line 151.

Switch 110, when moved to the right, cuts off power to the ceiling lamps and keeps them from flashing on and off as any one of switches 54 is pressed and released to control the motors. Switch 110 also bypasses 62, 58 and 133 to allow manual jog operation of the motors while overriding the safety circuits.

Switch 152 is normally open. When it is closed, current is fed to winding 148 through diode 153 and conductor 122. As described above, the actuation of relay 115 opens contacts 114 and normalizes any of the locking circuits which may have maintained current in any of the windings 53 and 71. Closure of switch 152 also energizes the warning buzzer 81.

Switch 120 is normally closed and in series with the winding 121 of the stepping relay 96. When switch 120 is opened the stepping relay cannot be operated by any of the switches 54.

Switch 102 normally is connected in series with contacts 100, 97, and 114. When thrown to the right, these contacts are bypassed and one terminal of switches 54 is connected directly to the positive conductor 65 via diodes such as 104.

The operation of all the four safety switches permits an operator to move any of the movable stacks in either direction by operation of button 38. As soon as the button 38 is released, the motor stops, there being no closed locking circuit.

It should also be noted that disconnecting the main circuit breaker 42 (FIG. 8) normalizes all the circuits and relays and permits an operator to push any movable stack by hand to a desired position.

Having thus fully described the invention, what is claimed as new and desired to be secured by Letters Patents is:

1. A storage means with shiftable units for personnel access thereto comprising; a plurality of movable storage stacks for storage of material mounted in parallel relationship to each other; movable supporting means for each of said stacks to be moved for providing access space between any two of the stacks, each supporting means including a rotatable shaft, wheels on the shaft, and a reversible electric motor coupled to the shaft; relay means for controlling the direction of rotation of the motors; a plurality of manually operable switches for selecting the access aisle to be used; a first relay control circuit actuated by one of said switches for first energizing the motor of the stack adjacent an initially open aisle and sequentially operating the motors of the other stacks for sequentially moving the stacks between the initially open aisle and the selected aisle; a plurality of sensing switches for cutting off the current to the stack motors when the stacks move too close to each other; and a second relay control circuit connected to the manually operable switches for returning the control circuits to their original condition at the end of a motor and access operation.

2. A storage means as claimed in claim 1 wherein each of said manually operable switches is connected to a locking circuit for maintaining the action of the motors until the access operation is completed.

3. A storage means as claimed in claim 1 wherein said first relay control circuit includes circuit means for selectively lighting a lamp over the access aisle for the duration of the access time.

4. A storage means as claimed in claim 1 wherein said second relay control circuit includes a stepping relay having an armature operable when the relay receives current, a ratchet wheel operable by the return of said armature, a cam connected to the ratchet wheel, and a pair of locking contacts opened by said cam every second actuation of the relay, said locking contacts connected in series with a locking circuit connected to the second relay control circuit.

5. A storage means as claimed in claim 1 wherein a series of floor level switches are positioned in each access aisle and are connected to a safety circuit which opens the motor feed lines whenever a person steps on the floor.

6. A storage means as claimed in claim 1 wherein a series of waist level switches are coupled to safety bars on each side of each access aisle, said waist level switches each connected to a safety circuit which opens the motor feed lines whenever a person presses against one of said rods.

7. A storage means as claimed in claim 1 wherein the stack sensing switches are each connected to a sensing rod which projects beyond the stack boundary surface and actuates a sensing switch whenever two adjacent stacks are moved together.

8. A storage means as claimed in claim 1 wherein a plurality of safety switches are coupled to a single operating handle for disconnecting lamps, sounding an alarm, disconnecting an electrical source of supply, and energizing a switching means for motor operation.

9. A storage means as claimed in claim 5 wherein said safety circuit includes a first normally actuated safety relay with all the floor level switches normally open and short circuit the safety relay winding when stepped upon.

10. A storage means as claimed in claim 6 wherein said waist level switches are part of a safety means which includes a second normally actuated safety relay having closed contacts in series with a power supply which is connected to the motor control relays, all of said waist level switches being normally open and adapted to short circuit the second safety relay winding when said rod is operated.

* * * * *